US008814602B2

(12) United States Patent
Mongold

(10) Patent No.: US 8,814,602 B2
(45) Date of Patent: Aug. 26, 2014

(54) IMPEDANCE ADJUSTABLE RIBS BETWEEN CONTACTS OF AN ELECTRICAL CONNECTOR

(71) Applicant: Samtec, Inc., New Albany, IN (US)

(72) Inventor: John Mongold, Middletown, PA (US)

(73) Assignee: Samtec, Inc., New Albany, IN (US)

( * ) Notice: Subject to any disclaimer, the term of this patent is extended or adjusted under 35 U.S.C. 154(b) by 44 days.

(21) Appl. No.: 13/719,690

(22) Filed: Dec. 19, 2012

(65) Prior Publication Data

US 2013/0164987 A1 Jun. 27, 2013

Related U.S. Application Data

(60) Provisional application No. 61/578,345, filed on Dec. 21, 2011.

(51) Int. Cl.
*H01R 24/00* (2011.01)
*H01R 13/6477* (2011.01)

(52) U.S. Cl.
CPC ..... *H01R 13/6477* (2013.01)
USPC ..... 439/626

(58) Field of Classification Search
USPC ..... 439/626–637
See application file for complete search history.

(56) References Cited

U.S. PATENT DOCUMENTS 5,181,855 A * 1/1993 Mosquera et al. ..... 439/74
5,195,899 A * 3/1993 Yatsu et al. ..... 439/101
5,318,463 A * 6/1994 Broschard et al. ..... 439/541.5
6,129,592 A * 10/2000 Mickievicz et al. ..... 439/701
6,666,702 B1 12/2003 Pickles
7,371,129 B2 5/2008 Mongold
2003/0129874 A1* 7/2003 Harper et al. ..... 439/590
2006/0134962 A1* 6/2006 Yeh ..... 439/352
2009/0124107 A1 5/2009 Zhu
2010/0255717 A1 10/2010 Jackson

FOREIGN PATENT DOCUMENTS

JP 10-270124 A 10/1998

OTHER PUBLICATIONS

Official Communication issued in International Patent Application No. PCT/US2012/070553, mailed on Apr. 29, 2013.

* cited by examiner

*Primary Examiner* — Chandrika Prasad
(74) *Attorney, Agent, or Firm* — Keating & Bennett, LLP

(57) ABSTRACT

A tuning body to be inserted into an electrical connector includes a base end and a plurality of ribs extending from the base end. The plurality of ribs is parallel or substantially parallel with respect to each other and is arranged to fit between electrical contacts of the electrical connector when the tuning body is inserted into the electrical connector. The electrical connector includes a first side wall, a second side wall, a first connector body arranged between the first side wall and the second side wall, and a second connector body arranged between the first side wall and second the second side wall. The second connector body is arranged a predetermined distance apart from the first connector body, and the electrical contacts of the electrical connector extend between the first connector body and the second connector body.

21 Claims, 12 Drawing Sheets

IMPEDANCE ADJUSTABLE RIBS BETWEEN CONTACTS OF AN ELECTRICAL CONNECTOR

BACKGROUND OF THE INVENTION

1. Field of the Invention

The present invention relates to electrical connectors. More specifically, the present invention relates to electrical connectors with adjustable impedances.

2. Description of the Related Art

Electrical connectors are used to place electrical devices, such as printed circuit boards, in communication with one another. An electrical connector includes electrical contacts or terminals adapted to transmit electrical signals to an electrical device or another electrical connector.

In some known electrical connectors, electrical contacts are supported on each end by one of a first connector body and a second connector body. The electrical contacts are often arranged in an array, with rows and columns of electrical contacts. An example of an electrical connector with contacts arranged in an array and supported by first and second connector bodies is disclosed in U.S. Pat. No. 7,371,129, incorporated herein in its entirety by reference.

Conventional electrical connectors are typically designed to be tuned to a specific impedance. Accordingly, if different impedance profiles are needed for an electrical device, a different electrical connector is required for each particular impedance profile of the electrical device, so that each electrical connector can perform optimally at the necessary impedance profile of the electrical device. Thus, according to conventional approaches, many different electrical connectors must be purchased or manufactured for electrical devices that require different electrical profiles, which results in significant material and labor costs.

Furthermore, conventional electrical connectors typically only provide a single impedance profile, within manufacturing tolerances, for all of the electrical contacts of the electrical connector. That is, in order to apply different impedance profiles to certain electrical contacts in a single electrical connector, an electrical connector would have to be designed to have different impedance profiles in different portions of the array of electrical contacts of the electrical connector.

However, such electrical connectors require complex construction and need careful choices of materials, making such a conventional approach cumbersome and costly to manufacture. Moreover, each electric connector only provides the specific impedance profile for which it is designed, and thus cannot be readily adapted to different electrical devices that require different impedance profiles. In addition, a different electrical connector must be designed and manufactured for each different impedance profile that is required.

SUMMARY OF THE INVENTION

To overcome the problems described above, preferred embodiments of the present invention provide an electrical connector that can quickly and easily be tuned to different impedance profiles.

A tuning body according to a preferred embodiment of the present invention is arranged to be inserted into an electrical connector and includes a base end and a plurality of ribs extending from the base end. The plurality of ribs is parallel or substantially parallel with respect to each other and is arranged to fit between electrical contacts of the electrical connector when the tuning body is inserted into the electrical connector. Further, the tuning body includes a dielectric material.

The plurality of ribs is preferably arranged to be disposed between rows of electrical contacts. When inserted into the electrical connector, the plurality of ribs is preferably arranged to extend along the entire length of each row of electrical contacts. When inserted into the electrical connector, the plurality of ribs is preferably arranged to extend along only a portion of each row of electrical contacts, such that a portion of each row of electrical contacts is not disposed next to one of the plurality of ribs. Furthermore, when inserted into the electrical connector, the plurality of ribs is preferably arranged to extend along only a certain row or certain rows of electrical contacts, such that at least one of the rows of electrical contacts is not between two of the plurality of ribs. The base end of the tuning body is preferably arranged to come into contact with a column of electrical contacts when the tuning body is inserted into the electrical connector.

The tuning body preferably includes a latch arranged to fit a notch of the electrical connector. The tuning body preferably includes a plastic material, a glass-reinforced epoxy laminate material, or a glass/fiber material. The tuning body also preferably includes a metallic material.

Preferably, at least one of the plurality of ribs of the tuning body is integral with the base end, such that the tuning body is a single, continuous element. Preferably, at least one of the plurality of ribs is a separate element that is attached to the base end. At least one edge of the tuning body is preferably beveled.

An electrical connector assembly according to a preferred embodiment of the present invention includes a first side wall, a second side wall, a first connector body arranged between the first side wall and the second side wall, a second connector body arranged between the first side wall and second the second side wall, a plurality of electrical contacts extending between the first connector body and the second connector body, and a tuning body including a base end and a plurality of ribs extending from the base end. The second connector body is arranged a predetermined distance apart from the first connector body, and the plurality of ribs is arranged between electrical contacts.

The plurality of electrical contacts is preferably arranged to be parallel or substantially parallel with respect to each other. Solder is preferably deposited at one end of each of the plurality of electrical contacts. The plurality of ribs includes at least one outer rib, the at least one outer rib arranged to fit between one of the rows of electrical contacts of the electrical connector and a side wall of the electrical connector.

Preferably, the tuning body converts an impedance profile of at least a portion of the electrical contacts from about 100Ω (differential) to about 85Ω (differential), or converts an impedance profile of at least a portion of the electrical contacts from about 50Ω (single-ended) to about 75Ω (single-ended), for example.

The second connector body preferably includes a polarization key extending therefrom. Preferably, at least one of the plurality of ribs of the tuning body is arranged to come into contact with the polarization key to prevent over-insertion of the tuning body into the electrical connector assembly. The polarization key preferably prevents the tuning body from being arranged in an improper orientation in the electrical connector assembly or inserted in an improper direction into the electrical connector assembly.

The above and other features, elements, characteristics, and advantages of the present invention will become more apparent from the following detailed description of the preferred embodiments of the present invention with reference to the attached drawings.

DETAILED DESCRIPTION OF THE PREFERRED EMBODIMENTS

Preferred embodiments of the present invention will now be described in detail with reference to FIGS. 1 to 11. Note that the following description is in all aspects illustrative and not restrictive, and should not be construed to restrict the applications or uses of the present invention in any manner.

Figure 1:
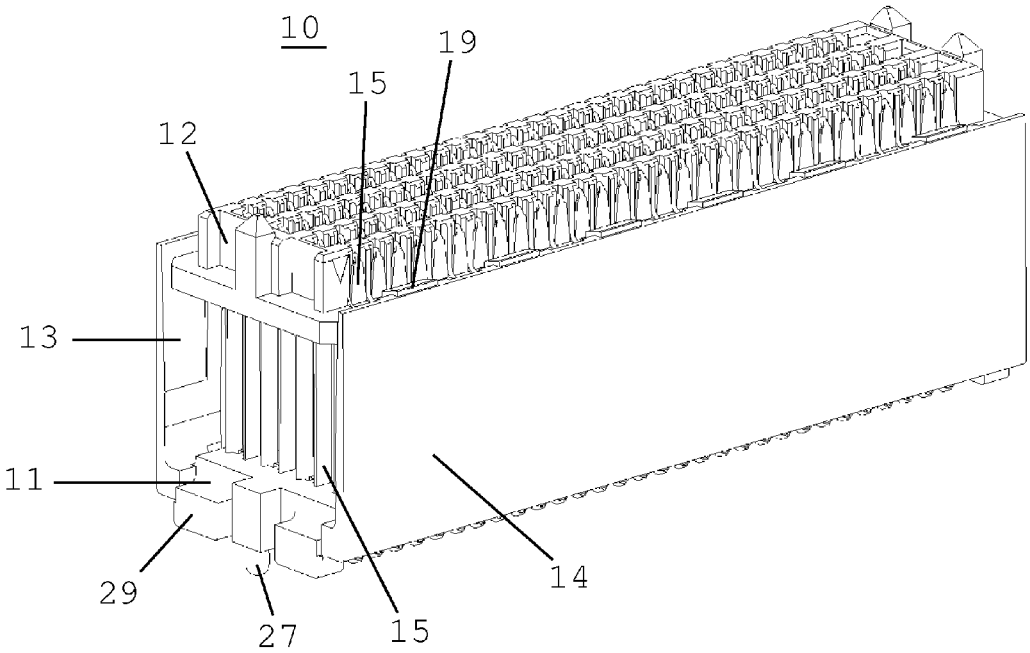
FIG. 1 is a perspective view of an electrical connector in accordance with a preferred embodiment of the present invention.

FIG. 1 is a perspective view of an electrical connector 10 in accordance with a preferred embodiment of the present invention. Electrical connector 10 includes a first connector body 11 and a second connector body 12. The first connector body 11 and the second connector body 12 position and support a plurality of electrical contacts 15. Preferably, the electrical contacts 15 are each formed in an elongated pin shape; however, the electrical contacts can have any suitable shape.

The first connector body 11 and the second connector body 12 are separated a certain distance apart by their arrangement with a first wall 13 and a second wall 14 of the electrical connector 10. A height of the electrical connector 10 is determined by the height of the first wall 13 and the second wall 14 and by the length of the electrical contacts 15. That is, by selecting the height of the first wall 13 and the second wall 14 and the lengths of the electrical contacts 15, the height of the electrical connector 10 can be selected. A plurality of ledges 19 in each of the first wall 13 and the second wall 14 helps to secure and position the second connector body 12. Preferably, the second connector body 12 is removable from the electrical connector 10.

As shown in FIG. 1, the electrical contacts 15 are preferably arranged in rows that are parallel or substantially parallel to the first wall 13 and the second wall 14. In particular, the electrical contacts 15 are preferably arranged in an array. However, the arrangement of electrical contacts is not limited to the arrangement shown in FIG. 1. For example, the electrical contacts 15 could be staggered, have an offset between columns or rows, etc.

Electrical contacts 15 preferably include a fusible material, for example, solder, on the ends of the contacts 15 that are arranged at the bottom of the electrical connector 10. The solder on the electrical contacts 15 is used to form a mechanical and electrical connection between the electrical connector 10 and a substrate (not shown). Typically, the electrical connector 10 would be reflowed/soldered to a printed circuit board (not shown). However, the electrical connector could be attached to any other suitable substrate. Various arrangements for the fusible material can be used, for example, crimped solder, solder balls, or solder charges. Further, instead of including solder on the electrical contacts 15, any other fusible material could be used to form the mechanical and electrical connection. Instead of having the solder on the electrical contact 15, the fusible material or solder could be provided on any substrate to which the electrical contact 15 is to be soldered. Moreover, other attachments may be used for the mechanical connection and the electrical connection between the electrical connector 10 and the substrate, for example, compliant pins, pogo pins, screw downs, etc.

As seen in FIG. 1, the first connector body 11 preferably includes at least one alignment pin 27. The alignment pin 27 is used to guide the electrical connector 10 to the proper location on a substrate at which the electrical connector 10 is to be attached. After the electrical connector 10 is located on the substrate and during the soldering process, standoffs 29, shown in FIG. 1, are used to fix the distance between the bottom of the electrical contacts 15 and the substrate to which the electrical connector 10 is to be soldered.

As shown in FIG. 1, the electrical contacts 15 of the electrical connector 10 are only separated by air along the length of the electrical contacts 15 extending between the first connector body 11 and the second connector body 12. That is, air is the dielectric material separating the electrical contacts 15 where the electrical contacts 15 extend between the first connector body 11 and the second connector body 12.

Figure 2:
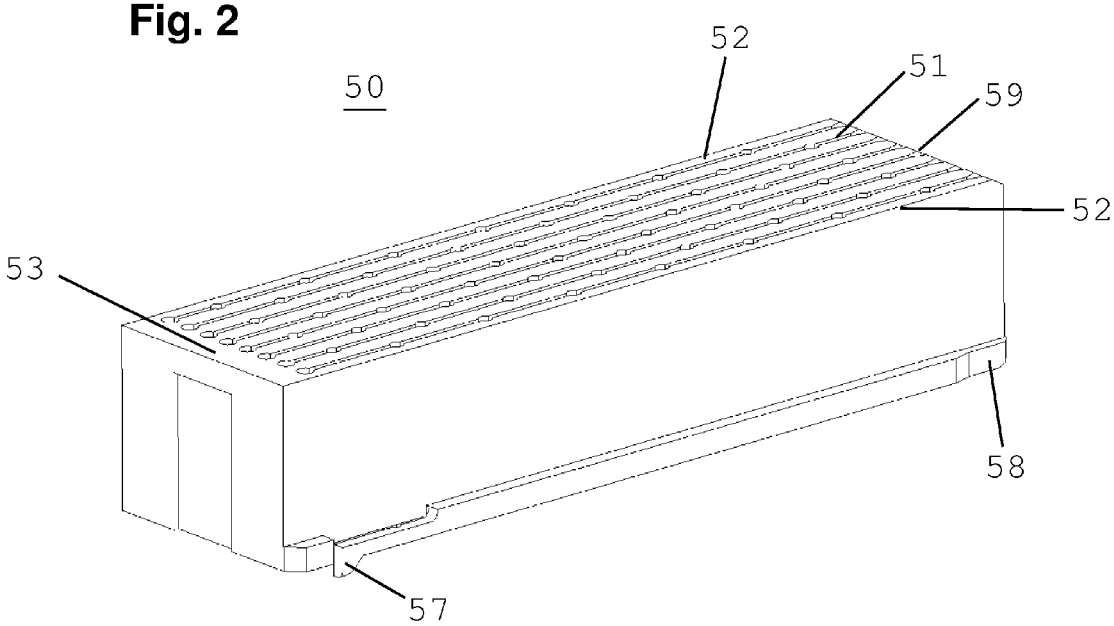
FIG. 2 is a perspective view of a tuning body in accordance with a preferred embodiment of the present invention.
Figure 3A:
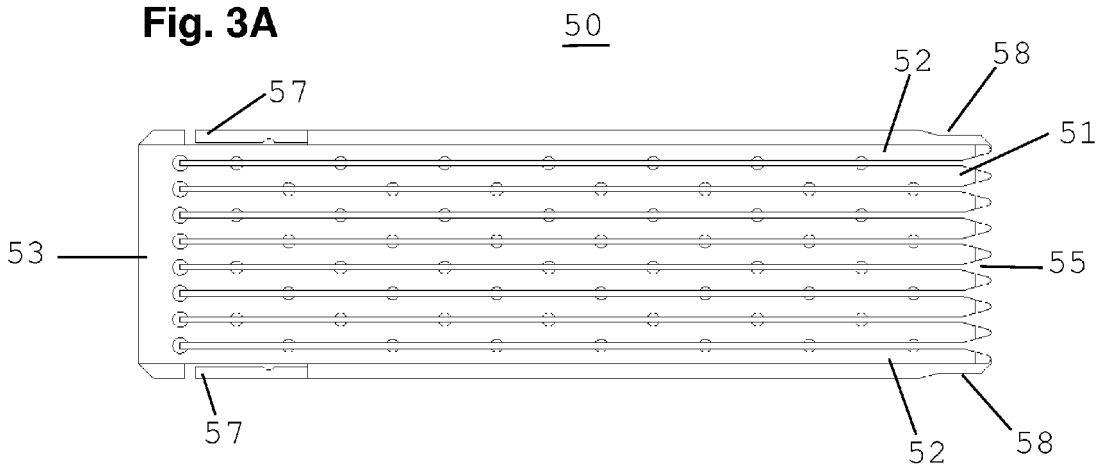
FIG. 3A is a top view of the tuning body of FIG. 2.

FIG. 2 is a perspective view of a tuning body 50 in accordance with a preferred embodiment of the present invention, and FIG. 3A is a top view of the tuning body of FIG. 2. Tuning body 50 includes a plurality of inner ribs 51 and two outer ribs 52 that extend from a base end 53.

As shown in FIGS. 2 and 3A, the inner ribs 51 and the outer ribs 52 of the tuning body 50 are arranged as parallel or substantially parallel, within manufacturing tolerances, spaced-apart slats that extend from the base end 53 of the tuning body 50. Accordingly, when the tuning body 50 is inserted into the electrical connector 10, the inner ribs 51 are between the rows of electrical contacts 15.

The tuning body 50 can be made of any suitable material or materials according to the desired dielectric properties or required impedance profile for the electrical connector 10. For example, the tuning body 50 may be made of any plastic materials, a glass-reinforced epoxy laminate material (such as FR-4), other glass/fiber materials, rubber, or similar nonmetallic materials. The inner ribs 51 and the outer ribs 52 may be integral with the base end 53, such that the tuning body 50 is a single, continuous element. Alternatively, the inner ribs 51 and the outer ribs 52 may be separate elements that are attached to the base end 53. Accordingly, the inner ribs 51 and the outer ribs 52 can be made of different materials, or of the same material but with different properties (e.g., density) in order to provide different impedance profiles. The tuning body 50 according to preferred embodiments of the present invention is preferably made using an injection molding process; however, any other suitable process can also be used. Furthermore, the tuning body 50 may be injected with air voids or glass beads.

The tuning body 50 may also include metallic materials, such as a hybrid alloy, to provide different electrical characteristics in the electrical connector 10, for example, a ground plane, a busbar, a reference plane, etc. The metallic materials included in the tuning body 50 may be arranged to be connected to a conductive trace included in a printed circuit board. The metallic materials may be plated or sprayed on the tuning body 50, or the tuning body 50 may be dipped in the metallic materials or wrapped in a thin foil. The metallic materials may be included in a single, continuous shape or included in segments along one or more of the inner ribs 51 and outer ribs 52. Furthermore, the tuning body 50 may include one or more of the following: capacitive, resistive, and inductive material in at least a portion of the inner ribs 51 and outer ribs 52.

Figure 3B:
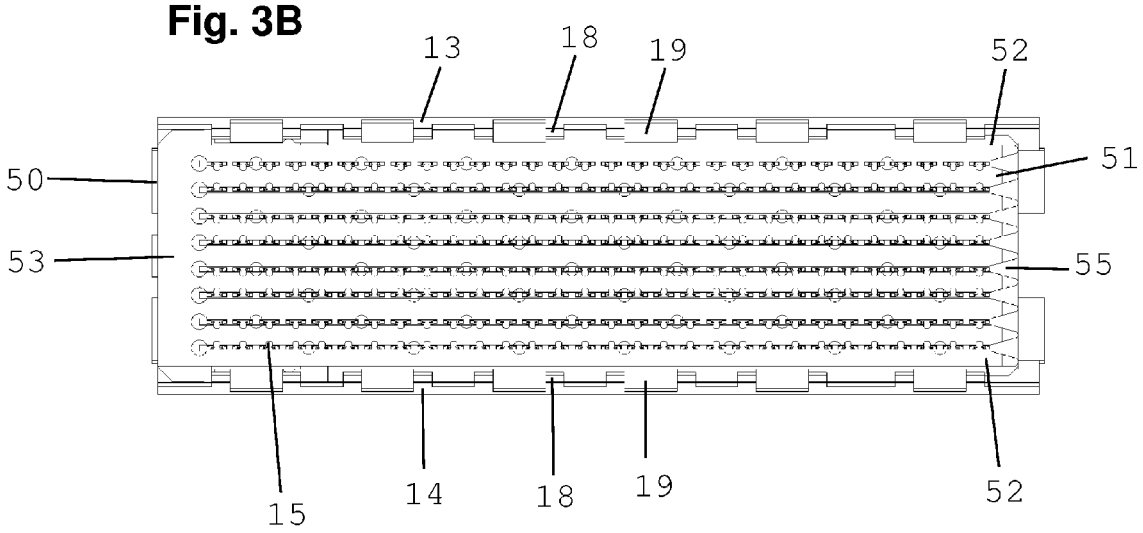
FIG. 3B is a top view of the electrical connector of FIG. 1 with the tuning body of FIG. 2 and without a second connector body.
Figure 3C:
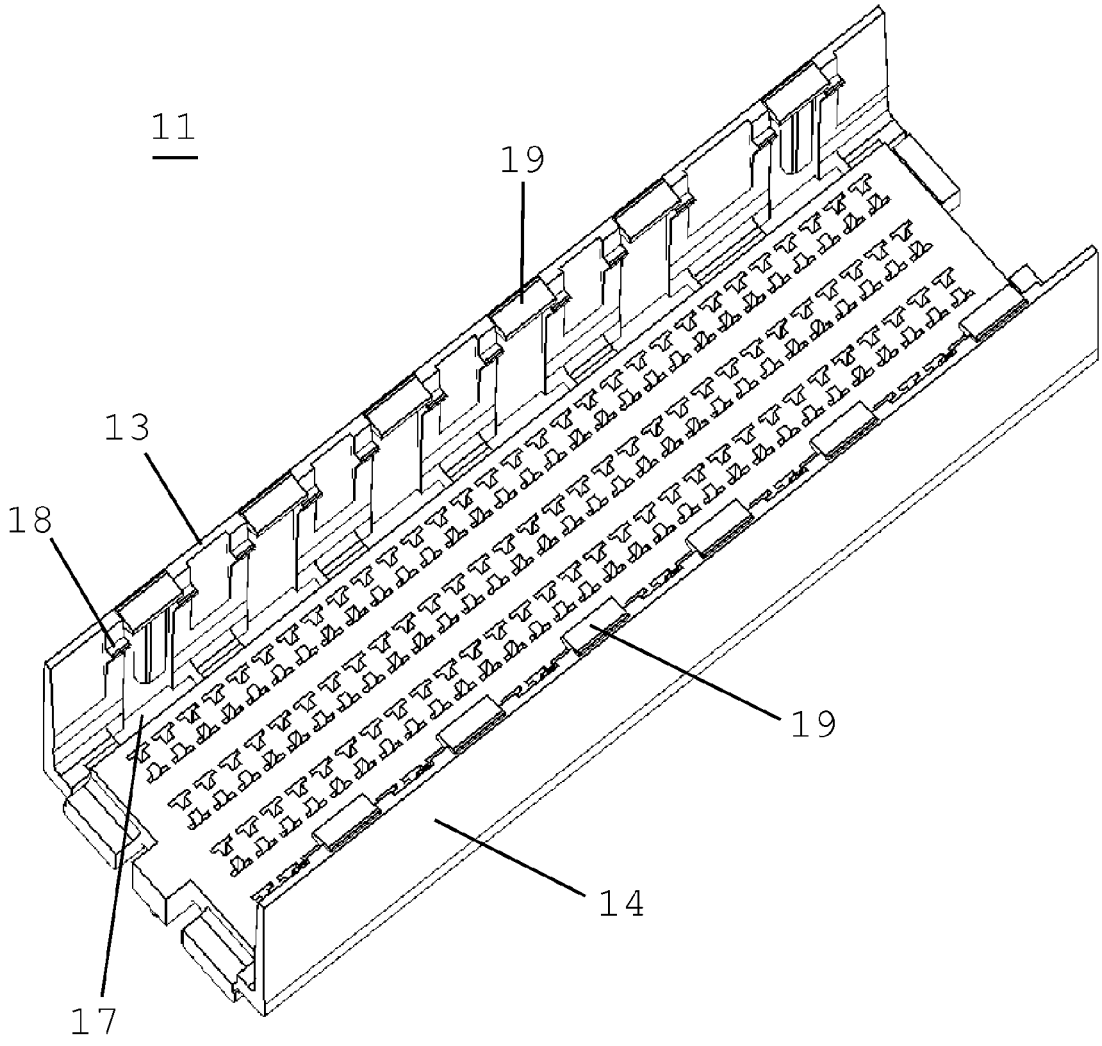
FIG. 3C is a perspective view of a first connector body of the electrical connector of FIG. 1.
Figure 4A:
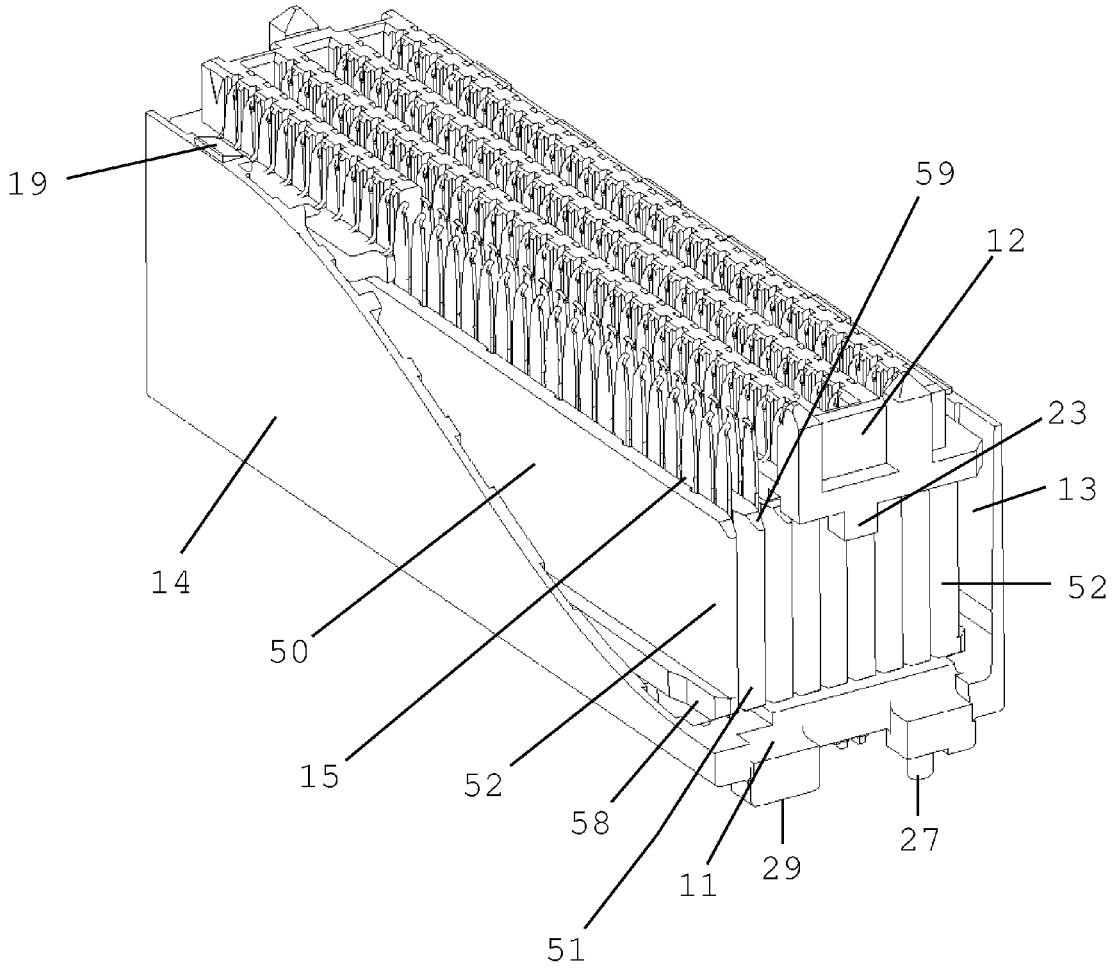
FIG. 4A is a perspective cutaway view of the electrical connector of FIG. 1 with the tuning body of FIG. 2.
Figure 4B:
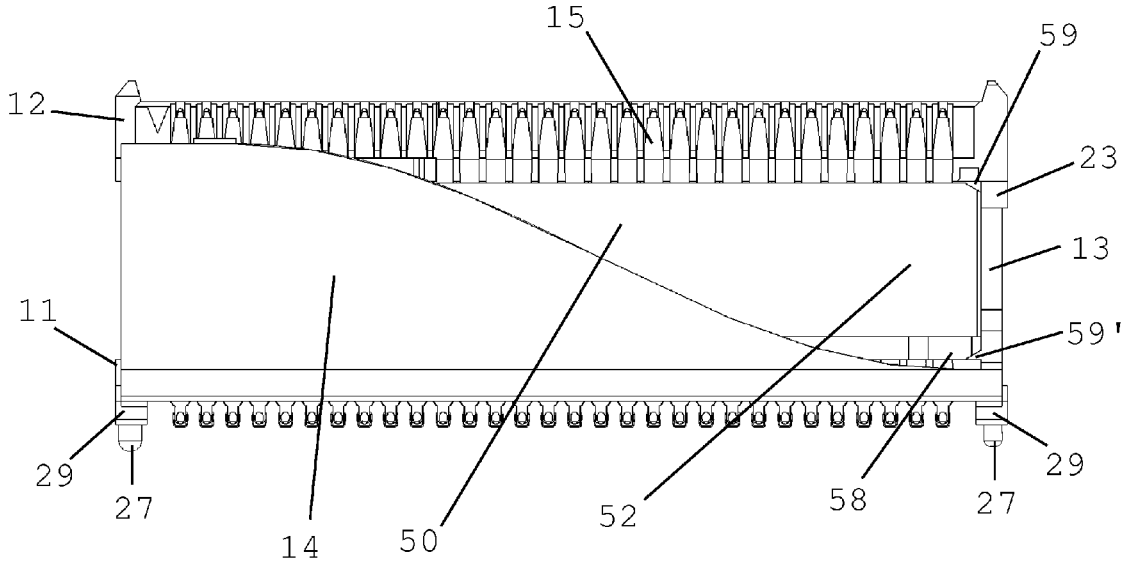
FIG. 4B is a side cutaway view of the electrical connector of FIG. 1 with the tuning body of FIG. 2.

FIG. 3B is a top view of the electrical connector 10 of FIG. 1 with the tuning body 50 of FIG. 2 and without the second connector body 12, FIG. 3C is a perspective view of the first connector body 11 of the electrical connector 10, and FIG. 4 is a perspective cutaway view of the electrical connector 10 of FIG. 1 with the tuning body 50 of FIG. 2. The second connector body 12 of the electrical connector 10 has been removed in FIG. 3B to more clearly show tuning body 50 and electrical contacts 15.

As seen in FIGS. 2 and 3A, the tuning body 50 preferably includes latches 57 arranged along bottom edges of outer ribs 52. Further, as seen in FIG. 3C, notches 17 are preferably included along the corners between the first wall 13 and the first connector body 11 and between the second wall 14 and the first connector body 11.

Accordingly, as shown in FIGS. 3B, 3C, and 4, when the tuning body 50 is inserted into the electrical connector 10, the latches 57 of the tuning body 50 engage with corresponding notches 17 in the first connector body 11 of the electrical connector 10 to help secure the tuning body 50 in the electrical connector 10 and to prevent the tuning body 50 from being withdrawn from the electrical connector 10 in a direction towards the base end 53 of the tuning body 50. As shown in FIGS. 3B and 3C, a plurality of ramps 18 in each of the first wall 13 and the second wall 14 helps to secure and position the second connector body 12.

Recesses 58, top beveled end 59, and bottom beveled end 59' are preferably included in the tuning body 50 to allow for easier insertion of the tuning body 50 into the electrical connector 10. Further, at a tip of each of the inner ribs 51 and outer ribs 52 that is opposite the base end 53, the interior sides of each of the inner ribs 51 and outer ribs 52 are preferably tapered to provide rib apertures 55 that also allow for easier insertion of the tuning body 50 into the electrical connector 10.

As shown in FIGS. 4A, 4B, 7, and 10, the second connector body 12 preferably includes a polarization key 23 extending therefrom. The polarization key 23 prevents the tuning body 50 from being inserted into the electrical connector 10 in an improper direction or an improper orientation. That is, the polarization key 23 only allows the tuning body 50 to be inserted into the electrical connector 10 at an end of the electrical connector 10 that does not include the polarization key 23. Furthermore, the polarization key 23 prevents the tuning body 50 from being inserted too far into the electrical connector 10, which may damage electrical contacts 15 if they are struck by the base end 53 of the tuning body 50. Instead of using polarization key 23 as shown in FIGS. 4A, 4B, 7, and 10, any other suitable polarization key or alignment mechanism could be used. In particular, the base end of the tuning body 53 may be used to prevent over-insertion of the tuning body 50 into the electrical connector 10. That is, the tuning body 50 and the electrical connector 10 may be arranged such that the column of contacts 15 that is closest to the base end 53 rest against the base end 53 when the tuning body 50 is fully inserted into the electrical connector 10.

Thus, according to the preferred embodiments of the present invention, when the inner ribs 51 of the tuning body 50 are arranged between adjacent rows of electrical contacts 15 of the electrical connector 10, the inner ribs 51 change the dielectric characteristics between the adjacent rows of electrical contacts 15, thereby changing the impedance profile of the electrical connector 10. As described above, the inner ribs 51 and the outer ribs 52 can be made of different materials, or of the same material but with different properties (e.g., density) in order to provide different impedance profiles among the adjacent rows of electrical contacts 15.

Figure 5:
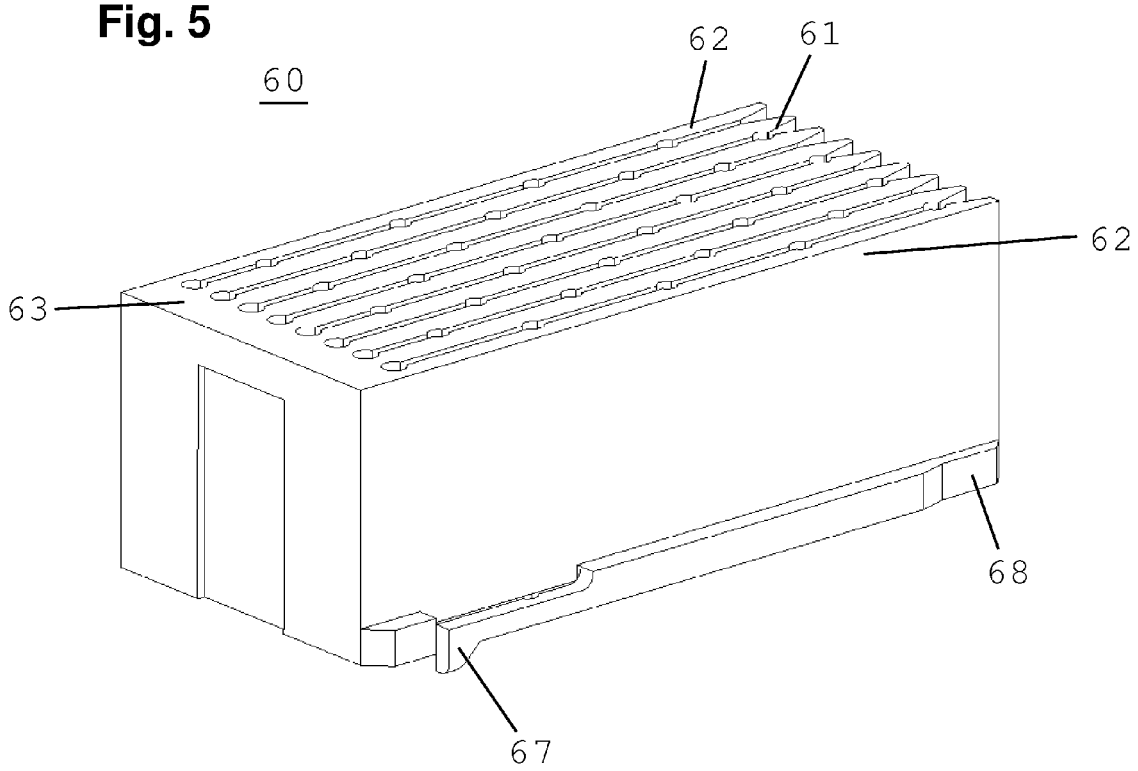
FIG. 5 is a perspective view of a tuning body in accordance with a preferred embodiment of the present invention.
Figure 6A:
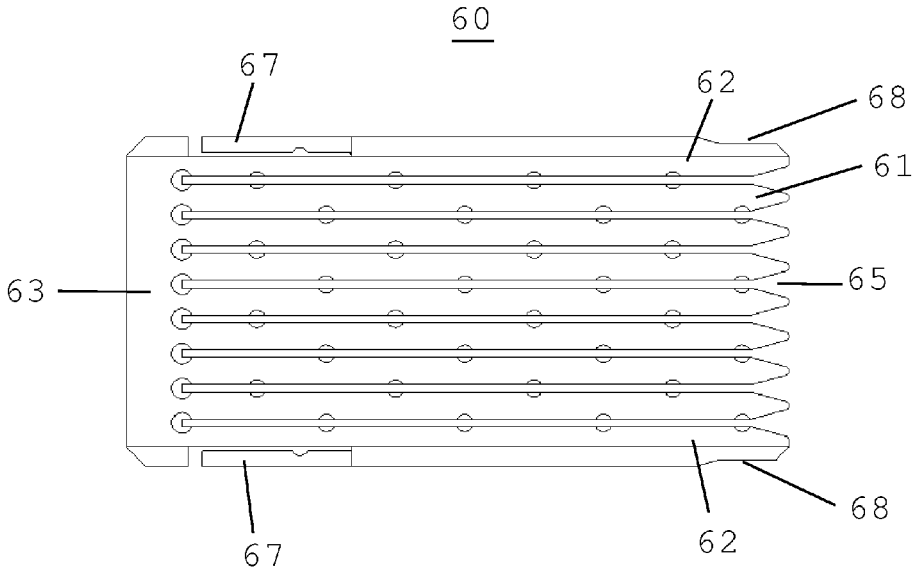
FIG. 6A is a top view of the tuning body of FIG. 5.

FIG. 5 is a perspective view of a tuning body 60 in accordance with a preferred embodiment of the present invention, and FIG. 6A is a top view of the tuning body of FIG. 5. Tuning body 60 includes a plurality of inner ribs 61 and two outer ribs 62 that extend from a base end 63.

As shown in FIGS. 5 and 6A, the inner ribs 61 and the outer ribs 62 of the tuning body 60 are arranged as parallel or substantially parallel, within manufacturing tolerances, spaced-apart slats that extend from the base end 63 of the tuning body 60. Accordingly, when the tuning body 60 is inserted into the electrical connector 10, the inner ribs 61 are between a portion of the rows of electrical contacts 15. The tuning body 60 can be made of any suitable material or materials according to the desired dielectric properties or required impedance profile for the electrical connector 10. In particular, the tuning body 60 can be made of the same materials as those described herein with regard to tuning body 50.

Figure 6B:
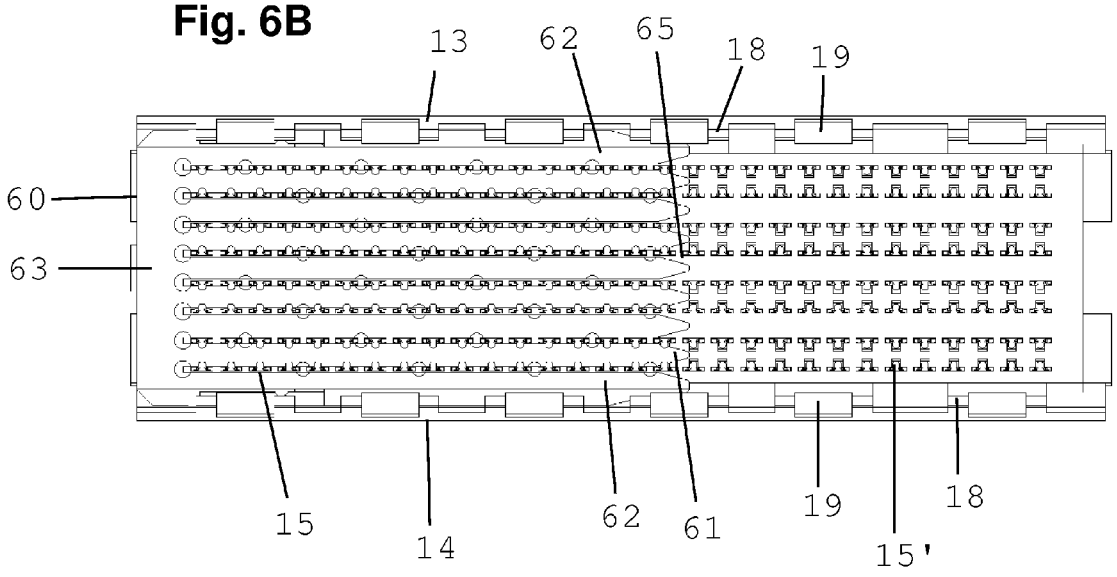
FIG. 6B is a top view of the electrical connector of FIG. 1 with the tuning body of FIG. 5 and without the second connector body.
Figure 7:
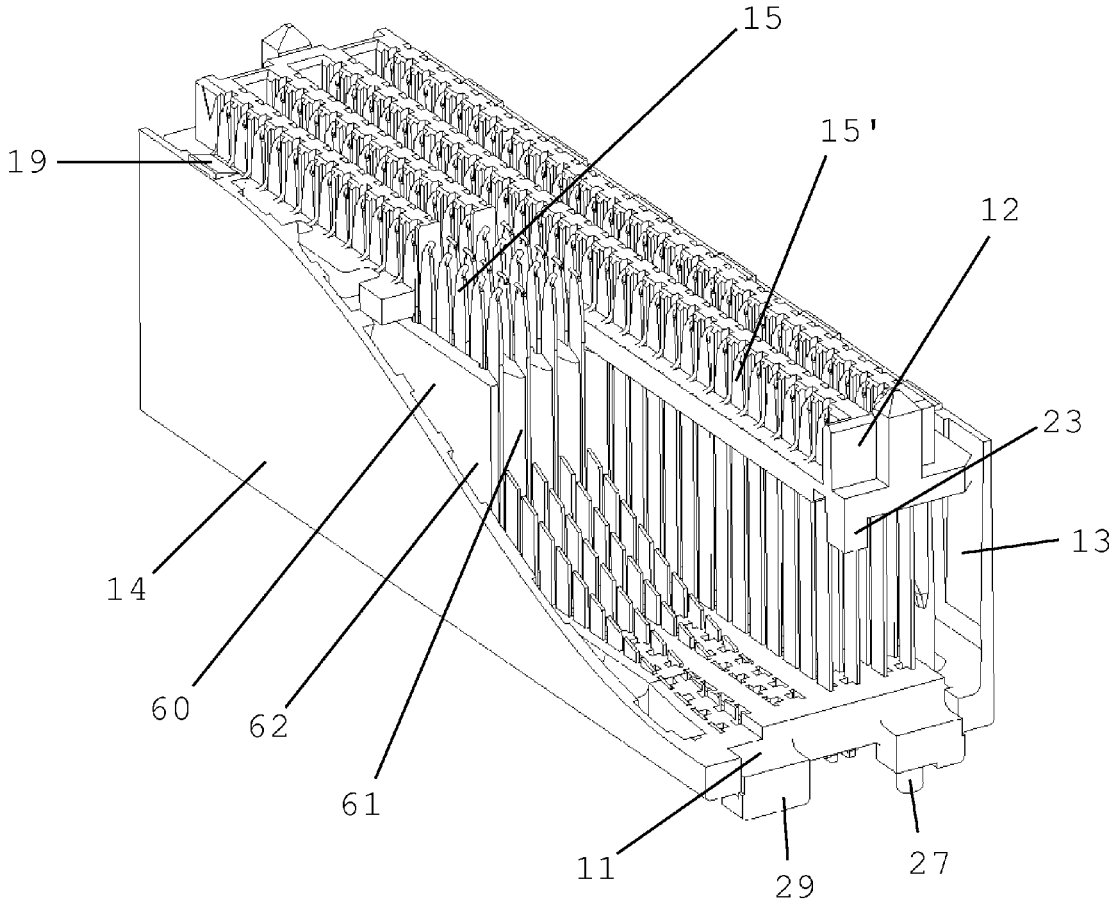
FIG. 7 is a perspective cutaway view of the electrical connector of FIG. 1 with the tuning body of FIG. 5.

FIG. 6B is a top view of the electrical connector 10 of FIG. 1 with the tuning body 60 of FIG. 5 and without the second connector body 12, and FIG. 7 is a perspective cutaway view of the electrical connector 10 of FIG. 1 with the tuning body 60 of FIG. 5. The second connector body 12 of the electrical connector 10 has been removed in FIG. 6B to more clearly show tuning body 60 and electrical contacts 15.

As seen in FIGS. 5 and 6A, the tuning body 60 preferably includes latches 67 arranged along bottom edges of outer ribs 62. Further, as described herein with regard to FIG. 3C, notches 17 are preferably included along the corners between the first wall 13 and the first connector body 11 and between the second wall 14 and the first connector body 11.

Accordingly, as shown in FIGS. 3C, 6B, and 7, when the tuning body 60 is inserted into the electrical connector 10, the latches 67 of the tuning body 60 engage with corresponding notches 17 in the first connector body 11 of the electrical connector 10 to help secure the tuning body 60 in the electrical connector 10 and to prevent the tuning body 60 from being withdrawn from the electrical connector 10 in a direction towards the base end 63 of the tuning body 60.

Recesses 68 are preferably included in the tuning body 60 to allow for easier insertion of the tuning body 60 into the electrical connector 10. Further, at a tip of each of the inner ribs 61 and outer ribs 62 that is opposite the base end 63, the interior sides of each of the inner ribs 61 and outer ribs 62 are preferably tapered to provide rib apertures 65 that also allow for easier insertion of the tuning body 60 into the electrical connector 10. The tuning body 60 can have a top beveled end and a bottom beveled end similar to the top beveled end 59 and the bottom beveled end 59' of tuning body 50. The base end of the tuning body 63 may be used to prevent over-insertion of the tuning body 60 into the electrical connector 10. That is, the tuning body 60 and the electrical connector 10 may be arranged such that the column of contacts 15 that is closest to the base end 63 rest against the base end 63 when the tuning body 60 is fully inserted into the electrical connector 10.

As compared to tuning body 50, the inner ribs 61 and the outer ribs 62 of tuning body 60 extend along only part of the length of the electrical connector 10. Thus, only the electrical contacts 15 that are arranged near the inner ribs 61 and the outer ribs 62 have their impedance profiles changed, due to being separated by the tuning body 60. However, electrical contacts 15' that are arranged beyond the extent of the inner ribs 61 and the outer ribs 62 are only separated by air, and therefore do not have their impedance profiles changed.

Figure 8:
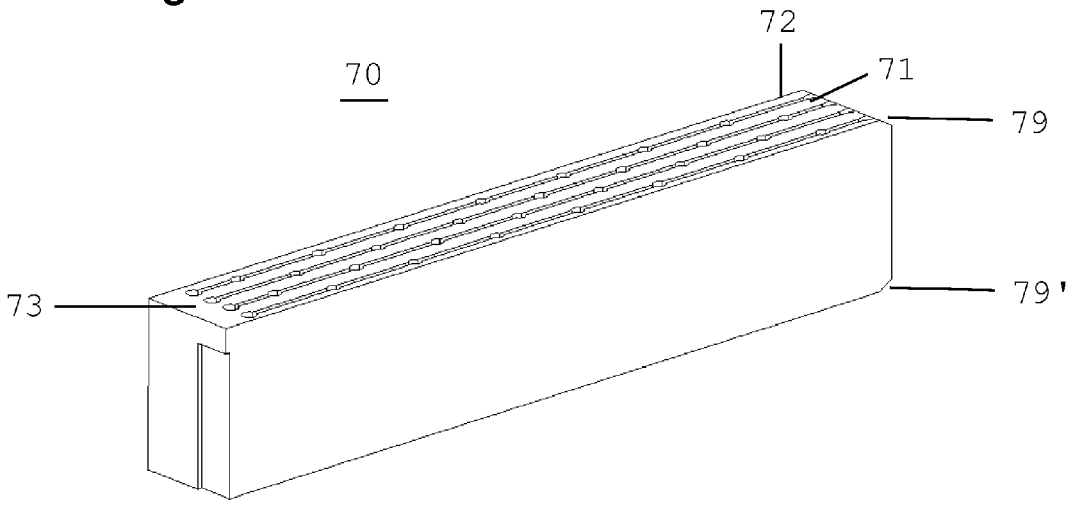
FIG. 8 is a perspective view of a tuning body in accordance with a preferred embodiment of the present invention.
Figure 9A:
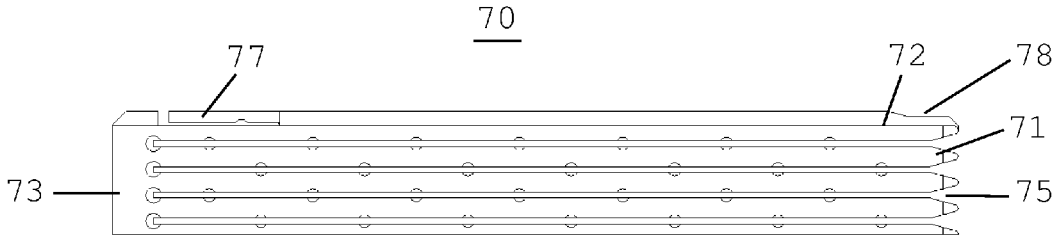
FIG. 9A is a top view of the tuning body of FIG. 8.

FIG. 8 is a perspective view of a tuning body 70 in accordance with a preferred embodiment of the present invention, and FIG. 9A is a top view of the tuning body of FIG. 8. Tuning body 70 includes a plurality of inner ribs 71 and one outer rib 72 that extend from a base end 73.

As shown in FIGS. 8 and 9A, the inner ribs 71 and the outer rib 72 of the tuning body 70 are arranged as parallel or substantially parallel, within manufacturing tolerances, spaced-apart slats that extend from the base end 73 of the tuning body 70. Accordingly, when the tuning body 70 is inserted into the electrical connector 10, the inner ribs 71 are between a portion of the rows of electrical contacts 15. The tuning body 70 can be made of any suitable material or materials according to the desired dielectric properties or required impedance profile for the electrical connector 10. In particular, the tuning body 70 can be made of the same materials as those described herein with regard to tuning body 50.

Figure 9B:
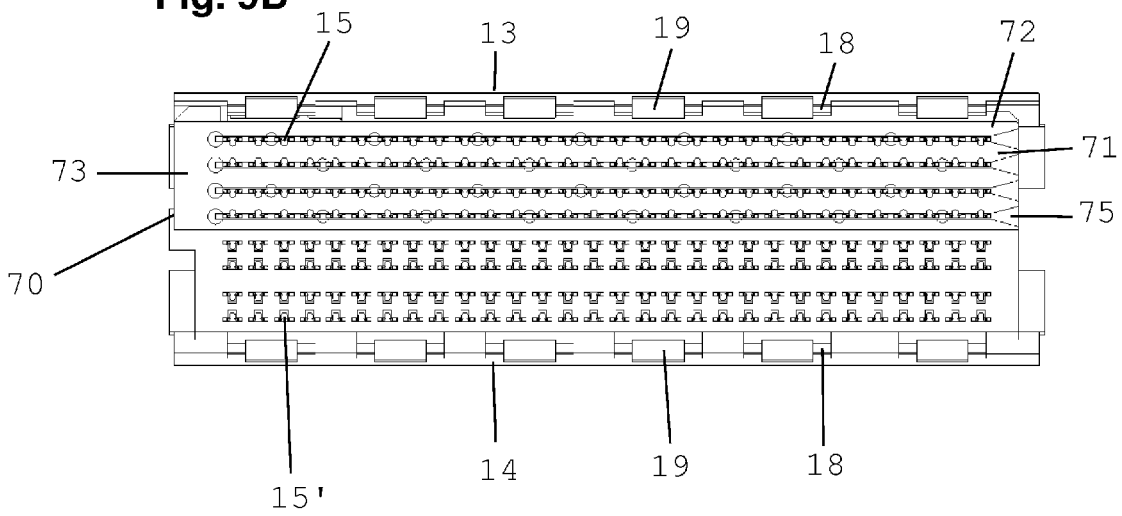
FIG. 9B is a top view of the electrical connector of FIG. 1 with the tuning body of FIG. 8 and without the second connector body.
Figure 10:
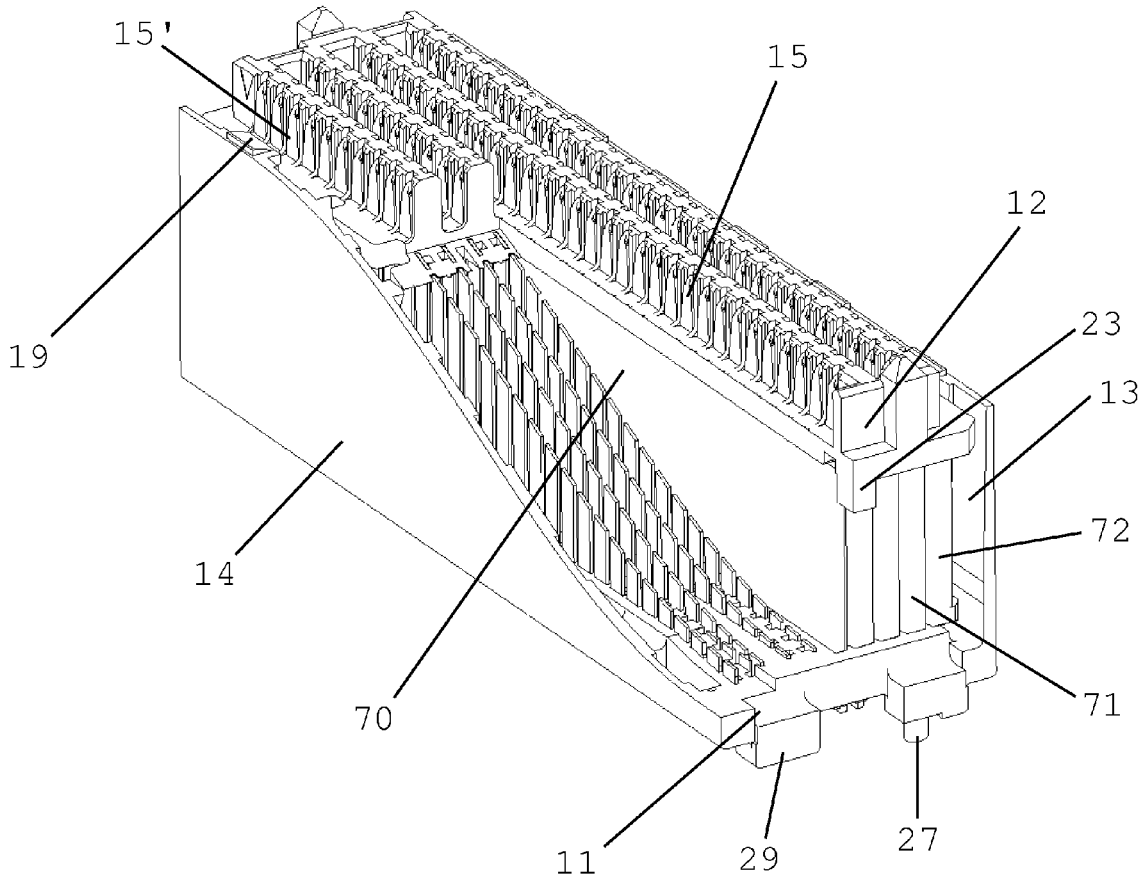
FIG. 10 is a perspective cutaway view of the electrical connector of FIG. 1 with the tuning body of FIG. 8.

FIG. 9B is a top view of the electrical connector 10 of FIG. 1 with the tuning body 70 of FIG. 8 and without the second connector body 12, and FIG. 10 is a perspective cutaway view of the electrical connector 10 of FIG. 1 with the tuning body 70 of FIG. 8. The second connector body 12 of the electrical connector 10 has been removed in FIG. 9B to more clearly show tuning body 70 and electrical contacts 15.

As seen in FIG. 9A, the tuning body 70 preferably includes a latch 77 arranged along bottom edges of the outer rib 72. Further, as described herein with regard to FIG. 3C, notches 17 are preferably included along the corners between the first wall 13 and the first connector body 11 and between the second wall 14 and the first connector body 11.

Accordingly, as shown in FIGS. 3C, 9B, and 10, when the tuning body 70 is inserted into the electrical connector 10, the latch 77 of the tuning body 70 engages with one of the notches 17 in the first connector body 11 of the electrical connector 10 to help secure the tuning body 70 in the electrical connector 10 and to prevent the tuning body 70 from being withdrawn from the electrical connector 10 in a direction towards the base end 73 of the tuning body 70.

A recess 78, top beveled end 79, and bottom beveled end 79' are preferably included in the tuning body 70 to allow for easier insertion of the tuning body 70 into the electrical connector 10. Further, at a tip of each of the inner ribs 71 and the outer rib 72 that is opposite the base end 73, the interior sides of each of the inner ribs 71 and the outer rib 72 are preferably tapered to provide rib apertures 75 that also allow for easier insertion of the tuning body 70 into the electrical connector 10. As discussed herein and as shown in FIG. 10, the second connector body 12 preferably includes a polarization key 23 that prevents the tuning body 70 from being inserted into the electrical connector 10 in an improper direction. Furthermore, the polarization key 23 prevents the tuning body 70 from being inserted too far into the electrical connector 10, which may damage electrical contacts 15 if they are struck by the base end 73 of the tuning body 70. Instead of using the polarization key 23, any other suitable polarization key or alignment mechanism could be used. In particular, the base end of the tuning body 73 may be used to prevent over-insertion of the tuning body 70 into the electrical connector 10. That is, the tuning body 70 and the electrical connector 10 may be arranged such that the column of contacts 15 that is closest to the base end 73 rest against the base end 73 when the tuning body 70 is fully inserted into the electrical connector 10.

As compared to tuning body 50, the inner ribs 71 and the outer rib 72 of tuning body 70 extend along only some of the rows of electrical contacts 15. Thus, only the electrical contacts 15 that are arranged near the inner ribs 71 and the outer rib 72 have their impedance profiles changed, due to being separated by the tuning body 70. However, electrical contacts 15' that are not arranged proximate to any of the inner ribs 71 and the outer rib 72 are only separated by air, and therefore do not have their impedance profiles changed.

Accordingly, tuning bodies 60, 70 according to preferred embodiments of the present invention allow for only a portion of the electrical contacts 15 of the electrical connector 10 to have their impedance profiles changed. The remaining portion of the electrical contacts 15' will not be influenced by the tuning bodies 60, 70.

Figure 11:
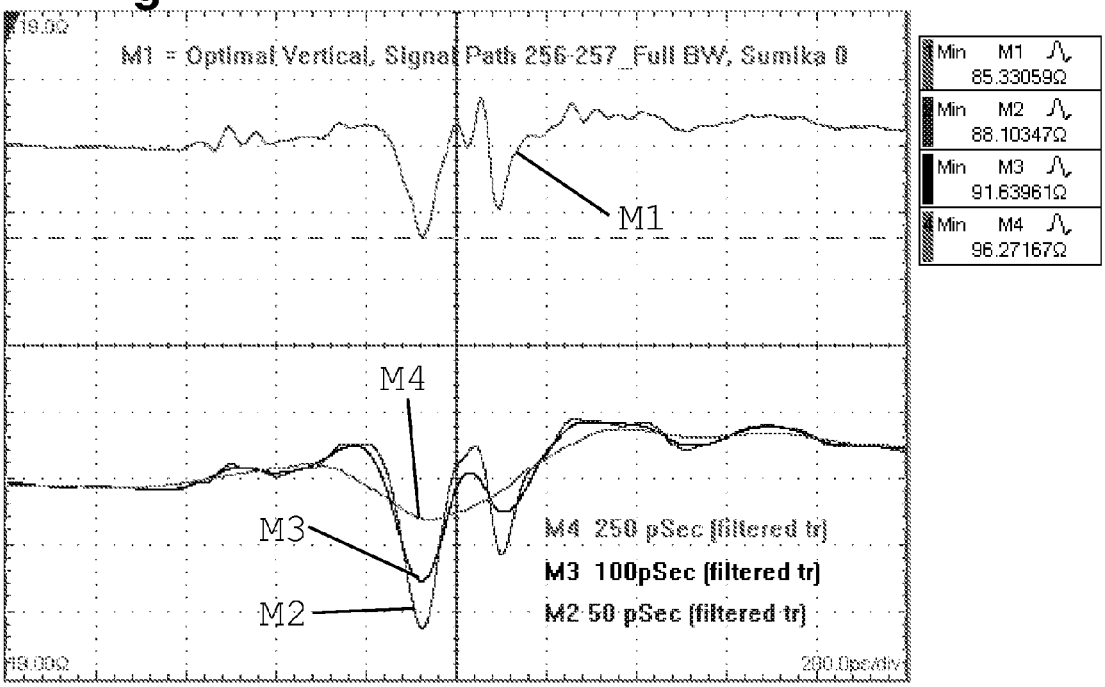
FIG. 11 is a graph showing the impedances for different signal rise-times as determined by empirical testing for a tuning body according to the preferred embodiments of the present invention.

FIG. 11 is a graph showing the impedances for different signal rise-times as determined by empirical testing of a tuning body according to the preferred embodiments of the present invention.

To obtain the empirical test results shown in FIG. 11, a previously designed test board that did not include an electrical connector was used. This test board was designed to test a known electrical connector in a 100Ω (differential) environment. That is, testing of a differential signal was performed by transmitting complementary signals on two paired electrical contacts of the electrical contacts 15. The testing was performed using testing equipment that included GIGA-TEST probes attached to a TEKTRONIX CSA (Communications Signal Analyzer) 8000. To test the tuning body, it was inserted into the electrical connector, and the electrical connector was connected to the test board. Then, a test signal was transmitted by the testing equipment, and the testing equipment monitored for a reflection of the test signal by the electrical connector. In particular, the test signal was sent from one of the probes to the test board trace, reflected at the connector, and then returned to the one of the probes via the test board trace. This reflected signal was then used to calculate an impedance value, and real-time results were displayed. The graph in FIG. 11 was adapted from a screen shot of the front panel of the TEKTRONIX CSA 8000.

Table 1 summarizes the results of testing performed on boards and electrical connectors with tuning bodies, similar to the testing described above with respect to FIG. 11. Ten boards were tested, and the maximum and minimum average impedances of each of the boards was determined. The Maximum Average Impedance and Minimum Average Impedance shown in Table 1 refer to the maximum and minimum values from among the average maximum and minimum impedances determined for each of the boards that were tested. Table 2 summarizes the results of similar testing performed on boards and electrical connectors without the tuning bodies except that Table 2 shows the maximum and minimum impedances tested.

TABLE 1

| Differential Impedance with Tuning Body | | | | | |
|---|---|---|---|---|---|
| Signal Risetime | 30 ps | 50 ps | 100 ps | 250 ps | 500 ps |
| Maximum Average Impedance (Ω) | 115.8 | 104.7 | 97.7 | 91.7 | 90.2 |
| Minimum Average Impedance (Ω) | 79.7 | 81.7 | 84.0 | 85.0 | 85.0 |

TABLE 2

| Differential Impedance without Tuning Body | | | | | |
|---|---|---|---|---|---|
| Signal Risetime | 30 ps | 50 ps | 100 ps | 250 ps | 500 ps |
| Maximum Impedance (Ω) | 136.2 | 125.3 | 114.2 | 105.1 | 102.6 |
| Minimum Impedance (Ω) | 88.2 | 93.6 | 96.5 | 99.9 | 99.9 |

As seen by comparing the impedances in Tables 1 and 2, the use of a tuning body according to the preferred embodiments of the present invention can lower the impedance of a connector from about 100Ω (differential), as shown in Table 2, to about 85Ω (differential), as shown in Table 1.

At longer rise-times (i.e., 250 ps), the results are much closer to 85Ω (differential) than 100Ω (differential). In particular, at shorter rise-times, discontinuities in the signal are exposed, and thus the characteristic impedance of a particular portion of the transmission path (e.g., trace, connector, etc.) can be better shown. At longer rise-times, the impedance of a particular portion of the transmission path will appear to be closer to the impedance of a system to which the connector is embedded.

Preferred embodiments of the present invention allow, for example, a 50Ω (differential) or 100Ω (differential) electrical connector to be converted to, for example, an 85Ω (differential) connector quickly and easily. This conversion can even be performed during or after manufacture of the electrical connector, or even while the electrical connector is installed in a system or device. Furthermore, according to the preferred embodiments of the invention, an electrical connector in a single-ended application can be converted from, for example, a 50Ω (single-ended) electrical connector to a 75Ω (single-ended) electrical connector. In a single-ended application, a signal is transmitted on only one electrical contact of the electrical contacts 15, in contrast to the transmission of complementary signals on two paired electrical contacts of the electrical contacts 15 in differential signaling.

Preferred embodiments of the present allow a selected or limited portion of an entire array of electrical contacts of an electrical connector to be converted from, for example, a 100Ω (differential) impedance profile to an 85Ω (differential) impedance profile or from, for example, a 50Ω (single-ended) impedance profile to a 75Ω (single-ended) impedance profile. In addition to converting a 100Ω (differential) impedance profile to an 85Ω (differential) impedance profile and to converting a 50Ω (single-ended) impedance profile to a 75Ω (single-ended) impedance profile, it is possible to change an impedance profile, either differential or single-ended, to any other suitable impedance profile.

The electrical connector 10 according to the preferred embodiments of the present invention is preferably an elevated array electrical connector. However, the preferred embodiments of the present invention are not so limited, and the tuning bodies 50, 60, 70 may be arranged to fit various types of electrical connectors.

As shown in FIGS. 2, 3A, 3B, 5, 6A, 6B, 8, 9A, and 9B, tuning bodies 50, 60, 70 according to the preferred embodiments of the present invention include semi-circular or substantially semi-circular indentations along interior sides of the inner ribs 51, 61, 71 and the outer ribs 52, 62, 72. The indentations may occur due to a manufacturing process of the tuning bodies 50, 60, 70, in order to improve flexibility of the tuning bodies 50, 60, 70 and to allow for easier insertion of the tuning bodies 50, 60, 70 into the electrical connector 10. In particular, these indentations may arise due to ridges arranged in plates of manufacturing equipment that are disposed between the inner ribs 51, 61, 71 and outer ribs 52, 62, 72 during manufacturing of the tuning bodies 50, 60, 70.

Preferred embodiments of the present invention allow an electrical connector to be tuned to different impedance profiles by inserting a tuning body into the electrical connector without adversely affecting the manufacturing of the electrical connector. That is, the same electrical connector is capable of being used for different impedance profiles. By adding the tuning body in the final manufacturing step, the impedance profile of the electrical connector can be changed without affecting the manufacturing process of the electrical connector.

The impedance Z of a tuning body can be determined according to the equation $Z=(83\div C_l))\times(\in_r)^{1/2}$, where $C_l$ is the capacitance per unit length of the electrical contacts 15 as affected by the presence of the tuning bodies 50, 60, 70, and $\in_r$ is the dielectric constant of the tuning body 50, 60, 70 that is being used. Thus, to obtain a tuning body with a particular impedance Z, a material with a suitable dielectric constant $\in_r$ may be selected. Accordingly, the tuning bodies 50, 60, 70 can provide an improved impedance profile in both differential and single-ended implementations by selecting an appropriate value of the dielectric constant $\in_r$ of the tuning bodies 50, 60, 70. A device such as a time-domain reflectometer (TDR) may be used to help determine the appropriate value of the dielectric constant $\in_r$ for a particular application. Furthermore, as shown above in Tables 1 and 2, at higher frequencies, the need increases for consistent dielectric properties in portions of the tuning bodies 50, 60, 70 that are near the electrical contacts 15 that carry signals.

Preferred embodiments of the present invention allow for only a portion of the connector assembly to be tuned to a different impedance profile by using a tuning body that is shorter in length or width so that only a portion of the pin field is tuned to the different impedance profile based on the size of the tuning body in comparison to the size of the electrical connector.

A tuning body according to the preferred embodiments of the present invention may provide multiple impedance profiles for the electrical connector 10, depending on the orientation that the tuning body is inserted into the electrical connector 10. As one example, the polarization key 23 may be modified or removed to permit the tuning body to be inserted into the electrical connector 10 from either end of the electrical connector 10. Furthermore, the tuning body according to preferred embodiments of the present invention can alternatively be inserted from the top, bottom, or sides of an electrical connector, instead of being inserted from the ends of the electrical connector 10 as shown in FIGS. 1-10.

Each of the first wall 13 and the second wall 14 preferably extend continuously from one end of the electrical connector 10 to the other end of the electrical connector 10. However, the first wall 13 and the second wall 14 do not need to extend continuously from one end of the electrical connector 10 to the other end of the electrical connector 10. That is, an electrical connector 10 can include discontinuities along the first wall 13 and the second wall 14. For example, cutouts in the first wall 13 and the second wall 14 may help reduce material costs, aid in heat dissipation, and reduce weight.

It should be noted that the electrical connector 10 described herein is shown as a "male" connector. A male connector includes a plurality of contacts that each engages a corresponding contact on a female connector when the male connector and the female connector are mated, thereby establishing electrical contact between substrates or devices that are respectively attached to the male connector and the female connector. The individual electrical contacts in the male and female connectors are used to conduct electrical signals or electrical power. The electrical connector according to the preferred embodiments of the present invention may be arranged as a female connector, for example, by changing the shape of the second connector body 12 and replacing the electrical contacts 15 with electrical contacts that are shaped for a female connector.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A tuning body to be inserted into an electrical connector, comprising:

a base end; and a plurality of ribs extending from the base end; wherein the plurality of ribs is parallel or substantially parallel with respect to each other;

the plurality of ribs is arranged to fit between electrical contacts of the electrical connector to change impedances of the electrical contacts when the tuning body is inserted into the electrical connector; and at least two of the plurality ribs are different from each other such that impedances of at least two of the electrical contacts of the electrical connector are changed differently from each other.

2. The tuning body of claim 1, wherein the plurality of ribs is arranged to be disposed between rows of electrical contacts.

3. The tuning body of claim 1, wherein, when inserted into the electrical connector, the plurality of ribs is arranged to extend along the entire length of each row of electrical contacts.

4. The tuning body of claim 1, wherein, when inserted into the electrical connector, the plurality of ribs is arranged to extend along only a portion of each row of electrical contacts, such that a portion of each row of electrical contacts is not disposed next to one of the plurality of ribs.

5. The tuning body of claim 1, wherein, when inserted into the electrical connector, the plurality of ribs is arranged to extend along only a certain row or certain rows of electrical contacts, such that at least one of the rows of electrical contacts is not between two of the plurality of ribs.

6. The tuning body of claim 1, wherein, when inserted into the electrical connector, the base end of the tuning body is arranged to come into contact with a column of electrical contacts.

7. The tuning body of claim 1, further comprising a latch arranged to fit a notch of the electrical connector.

8. The tuning body of claim 1, wherein the tuning body includes a plastic material, a glass-reinforced epoxy laminate material, or a glass/fiber material.

9. The tuning body of claim 1, wherein the tuning body includes a metallic material.

10. The tuning body of claim 1, wherein at least one of the plurality of ribs is integral with the base end, such that the tuning body is a single, continuous element.

11. The tuning body of claim 1, wherein at least one of the plurality of ribs is a separate element that is attached to the base end.

12. The tuning body of claim 1, wherein at least one edge of the tuning body is beveled.

13. An electrical connector assembly comprising:

a first side wall and a second side wall;

a first connector body arranged between the first side wall and the second side wall;

a second connector body arranged between the first side wall and second the second side wall and arranged a predetermined distance apart from the first connector body;

a plurality of electrical contacts extending between the first connector body and the second connector body; and a tuning body including a base end and a plurality of ribs extending from the base end; wherein the plurality of ribs is arranged between the plurality of electrical contacts;

for at least one pair of adjacent rows of the plurality of electrical contacts that transmit electrical signals, only one of the plurality of ribs is located between the at least one pair of adjacent rows of the plurality of electrical contacts.

14. The electrical connector assembly of claim 13, wherein the plurality of electrical contacts is arranged to be parallel or substantially parallel with respect to each other.

15. The electrical connector assembly of claim 13, wherein solder is deposited at one end of each of the plurality of electrical contacts.

16. The electrical connector assembly of claim 13, wherein:

the plurality of ribs includes at least one outer rib; and the at least one outer rib is arranged to fit between one of the rows of electrical contacts of the electrical connector and a side wall of the electrical connector.

17. The electrical connector assembly of claim 13, wherein the tuning body converts an impedance profile of at least a portion of the electrical contacts from about 100Ω (differential) to about 85Ω (differential).

18. The electrical connector assembly of claim 13, wherein the tuning body converts an impedance profile of at least a portion of the electrical contacts from about 50Ω (single-ended) to about 75Ω (single-ended).

19. The electrical connector assembly of claim 13, wherein the second connector body includes a polarization key extending therefrom.

20. The electrical connector assembly of claim 19, wherein at least one of the plurality of ribs of the tuning body is arranged to come into contact with the polarization key.

21. The electrical connector assembly of claim 19, wherein the polarization key prevents the tuning body from being arranged in an improper orientation in the electrical connector assembly or inserted in an improper direction into the electrical connector assembly.

* * * * *